US007975340B2

(12) United States Patent
Van Der Meijden et al.

(10) Patent No.: US 7,975,340 B2
(45) Date of Patent: Jul. 12, 2011

(54) AUTOMATIC SWIMMING POOL CLEANER DISCS AND ASSOCIATED COMPONENTS

(75) Inventors: Hendrikus Johannes Van Der Meijden, Midrand (ZA); Michael Edward Moore, Johannesburg (ZA)

(73) Assignee: Zodiac Pool Care Europe (FR)

( * ) Notice: Subject to any disclaimer, the term of this patent is extended or adjusted under 35 U.S.C. 154(b) by 993 days.

(21) Appl. No.: 11/888,294

(22) Filed: Jul. 31, 2007

(65) Prior Publication Data

US 2009/0031508 A1 Feb. 5, 2009

(51) Int. Cl.
*E04H 4/16* (2006.01)

(52) U.S. Cl. ..... 15/1.7; 15/246

(58) Field of Classification Search ..... 15/1.7, 15/246

See application file for complete search history.

(56) References Cited

U.S. PATENT DOCUMENTS 3,008,160 A * 11/1961 West ..... 15/1.7
5,421,054 A * 6/1995 Dawson et al. ..... 15/246
5,465,443 A 11/1995 Rice et al.

FOREIGN PATENT DOCUMENTS

WO WO-2005031090 4/2005
WO WO-2009017943 2/2009
ZA 9810964 5/2000

OTHER PUBLICATIONS

Annex to Form PCT/ISA/206 Communication Relating to the Results of the Partial International Search in related Application No. PCT/US2008/069573 dated Feb. 4, 2009.
U.S. Appl. No. 11/708,925, of Moore, et al.

* cited by examiner

*Primary Examiner* — Shay L Karls
(74) *Attorney, Agent, or Firm* — Dean W. Russell; Kilpatrick Townsend & Stockton LLP

(57) ABSTRACT

Separate covers for protruding portions of discs of automatic swimming pool cleaners are addressed. The covers may be placed onto protrusions, such as fins, and removed from the fins as needed. Version of the covers are made of material more rigid and having lower coefficient of friction than the fins to discourage lateral bending of the fins and decrease frictional contact of the fins with pool surfaces.

21 Claims, 5 Drawing Sheets

AUTOMATIC SWIMMING POOL CLEANER DISCS AND ASSOCIATED COMPONENTS

FIELD OF THE INVENTION

This invention relates to discs and associated components intended principally, although not necessarily exclusively, for cleaners of liquid-containing vessels and more particularly to automatic pool cleaners having discs with rigidized fins or other protrusions.

BACKGROUND OF THE INVENTION

U.S. Pat. No. 5,421,054 to Dawson, et al., commonly-owned with this application, illustrates examples of discs having flexible fins. The fins extend upward beyond the peripheries of the (generally planar portions of the) discs. As noted in the Dawson patent, these fins "assist [the disc] in maneuvering over many objects (such as drains, lights, valves, and nozzles) projecting from internal surfaces of pools." See Dawson, col. 2, 11. 59-61. Because located at the peripheries of discs, the fins also "contact most protrusions before the remainder[s] of" the discs. See id., 1. 63.

Commonly-owned U.S. Pat. No. 5,465,443 to Rice, et al. discloses additional examples of discs having flexible fins. Pending U.S. patent application Ser. No. 11/708,925 of Moore, et al. describes yet additional sample discs with flexible fins. The finned portions of these discs typically form the forwardmost structure of their associated pool cleaners, so that they usually contact protrusions and other obstacles in advance of the remainders of the cleaners. Stated in the Moore application is that the fins "provid[e] sufficient rigidity to [the] disc to enable it to ride over various objects, including many drains, lights, valves, and other nozzles, projecting from internal surfaces of pools." See Moore, p. 8, 11. 20-22.

In these and other discs having fins (or similar outwardly-extending protrusions), the fins and generally planar portions of the discs are usually integrally formed. The fins of the Dawson and Rice patents, for example, may be molded together with generally planar portions of the corresponding discs. Fins of the Moore application, likewise, may be molded together with the forward section of the disc.

Lacking, therefore, from these patents and application is any discussion of outwardly-extending protrusions that comprise multiple pieces. Similarly lacking is any discussion of adaptors for the fins to accommodate circumstances in which the coefficient of friction of, e.g., the leading edge of the disc needs to be decreased or when lateral bending of the fins needs to be discouraged. Also not specifically addressed is any mechanism for enhancing integrated movement of the fins and planar disc sections when desired.

SUMMARY OF THE INVENTION

The present invention includes components configured to resolve the foregoing issues. Among these components are separate members, or covers, for the fins or other protrusions. Facially resembling false fingernails in some embodiments, the covers may be placed onto fins and removed therefrom as needed. Presently-preferred versions of the covers are made from material (a) more rigid and (b) having lower coefficient of friction than the fins, hence both discouraging lateral bending of the fins and decreasing frictional contact with surfaces when certain obstacles or walls are encountered by a corresponding disc operating within a pool. Versions of the covers also may contact planar portions of the disc adjacent the fins, resulting in more coordinated upward movement of the fins and planar portions in selected circumstances.

A cover of the invention may, if desired, be molded or otherwise formed in a single piece, with a generally horizontal portion and an upwardly-curved, generally vertically-oriented portion. The interior of the cover is hollow, allowing it to slide onto (over) and receive a fin. Frictional contact between the fin and interior of the cover may retain the cover in place, especially (although not exclusively) when the fin has non-uniform width.

Included as part of the generally horizontal portion of the cover may be a lower cut-out into which the generally planar portion of a disc is fitted. So fitting the planar portion permits the cover to contact both a fin and the planar portion, allowing the cover to influence motion of both portions of the disc jointly. The lower cut-out also arguably helps guide the fin for receipt by the hollow receiving portion of the cover.

It thus is an optional, non-exclusive object of the present invention to provide covers for protruding portions of discs.

It also is an optional, non-exclusive object of the present invention to provide covers that are separable from the discs, which covers may be added or removed as necessary or desired.

It is a further optional, non-exclusive object of the present invention to provide covers made from material of greater rigidity than the protruding portions of discs with which they are associated.

It is, moreover, an optional, non-exclusive object of the present invention to provide covers made from material having lower coefficient of friction than the protruding portions of discs with which they are associated.

It is another optional, non-exclusive object of the present invention to provide covers which, when in use, retain associated protruding portions of a disc via frictional fit.

It is an additional object of the present invention to provide automatic swimming pool cleaners including discs with which the covers may be used.

Other features, advantages, and objects of the present invention will be apparent to those of requisite skill in appropriate fields with reference to the remaining text and drawings of this application.

DETAILED DESCRIPTION

Figure 1:
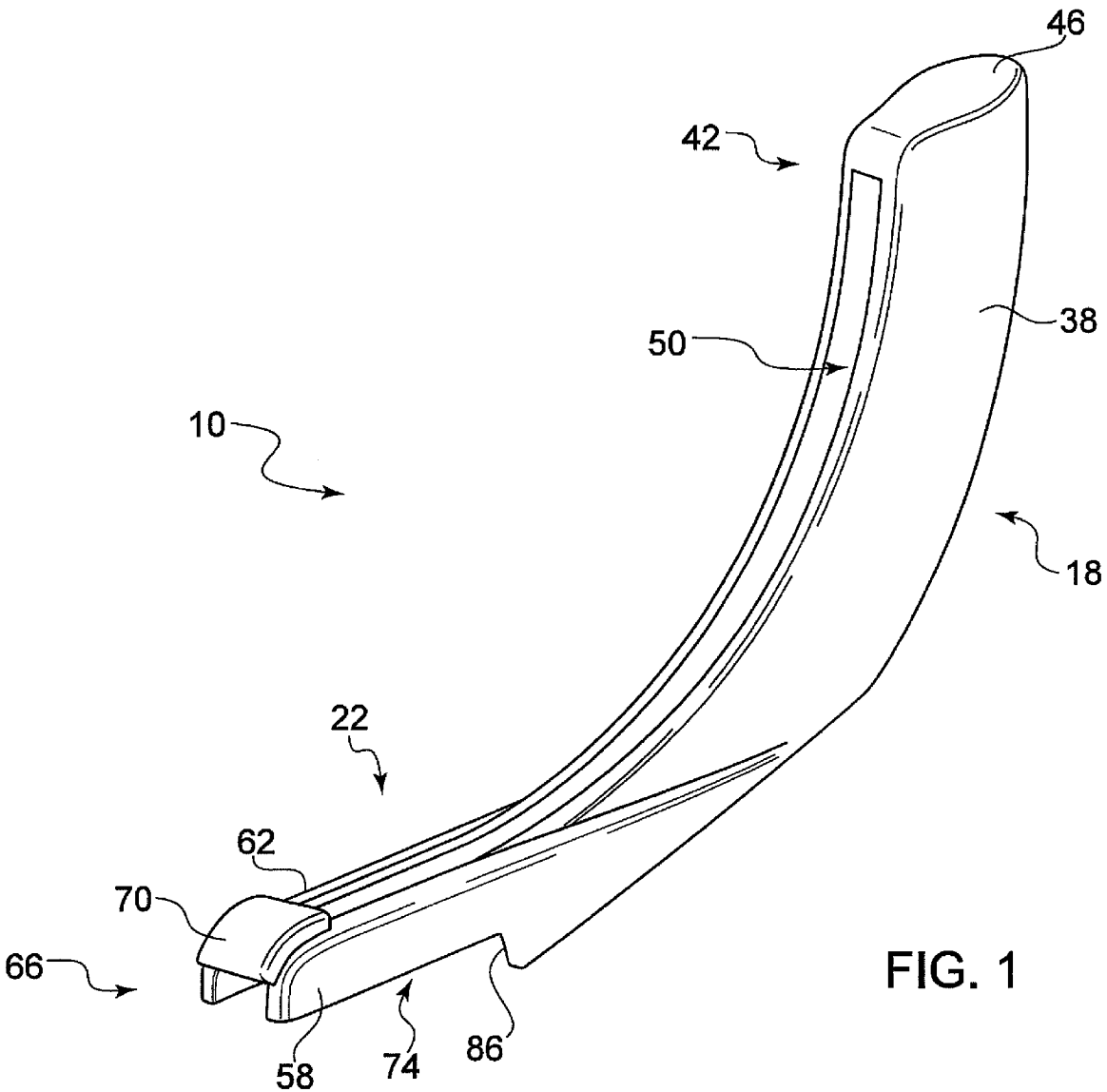
FIG. 1 is an isometric view of a cover of the present invention.
Figure 2:
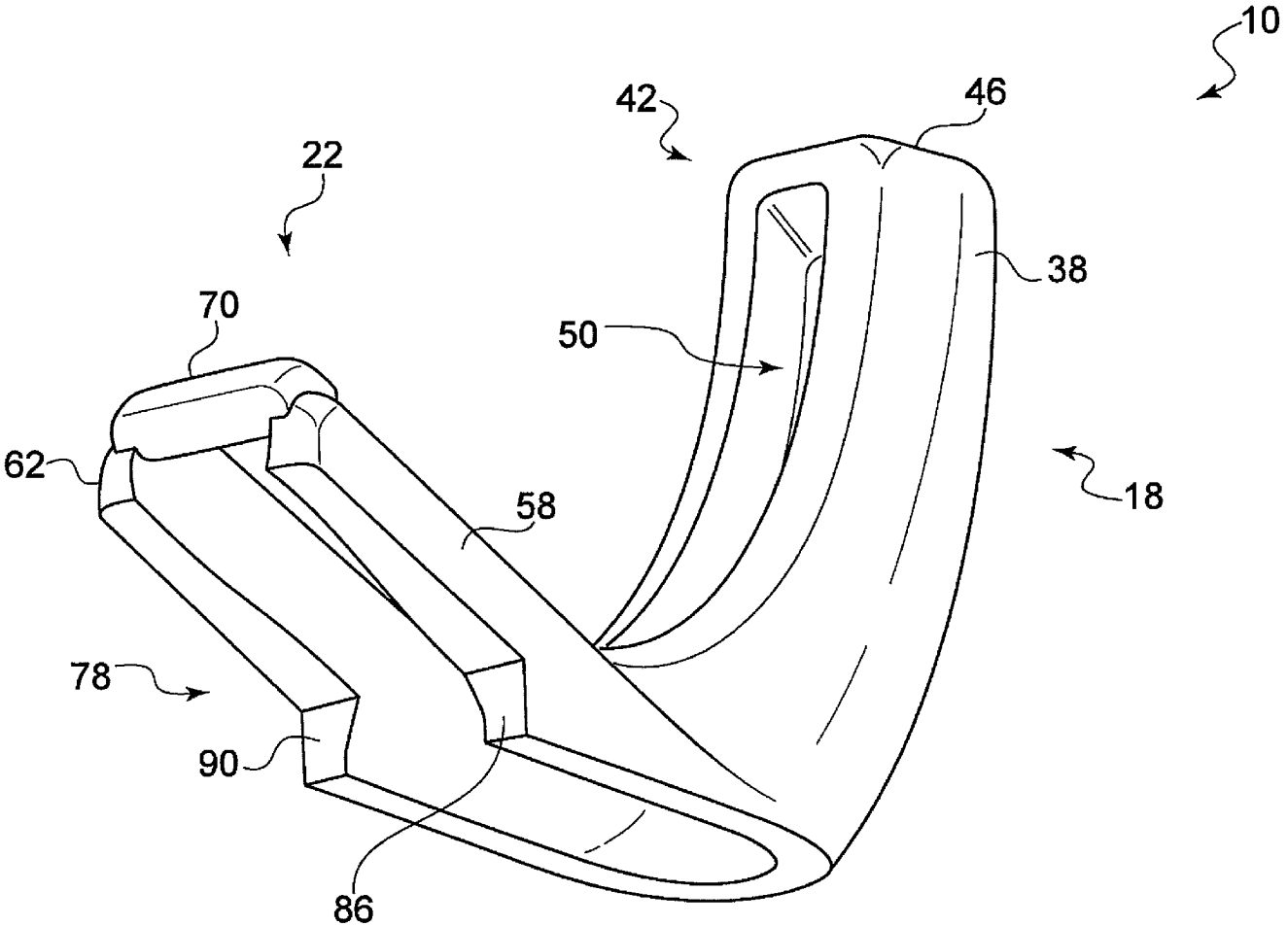
FIG. 2 is a worm's-eye view of the cover of FIG. 1.

Depicted in FIGS. 1-4 is exemplary member or cover 10 of the present invention. Presently preferred versions of cover 10 are one-piece structures molded into a rigid shape. In particular, cover 10 typically is designed to be substantially harder (i.e. more rigid) than 80 A Shore, the typical hardness of its associated disc 14. Alternatively, cover 10 may comprise more than one piece.

Whether a one- or multi-piece structure, cover 10 may include generally vertically-oriented portion 18 and generally horizontal portion 22. As shown in FIGS. 1-4, portion 18 may extend upward from portion 22. Portion 18 also may be curved, generally matching the shape of leading edges 26 of fins 30 spaced radially about disc 14 (see FIGS. 3-5). If protrusions shaped other than fins 30 extend outward beyond periphery 34 of disc 14, portion 18 may, of course, be shaped differently than as shown.

Generally vertically-oriented portion 18 may comprise wall 38 and, at upper end 42, cap 46. Wall 38 has generally U-shaped cross-section, thus forming hollow area 50 into which fin 30 may be frictionally fitted. Cap 46 functions as a stop, contacting uppermost part 54 of fin 30 when cover 10 is properly positioned.

Generally horizontal portion 22 may include spaced walls 58 and 62, with walls 58 and 62 being connected at end 66 by bridge 70. Walls 58 and 62 also are integrally formed with (or connected to) wall 38. Additionally incorporated into portion 22 may be cut-outs 74 and 78, in which parts of walls 58 and 62, respectively, are not present. Cut-outs 74 and 78, hence, may serve to receive generally planar portion 82 of disc 14. In such event respective edges 86 and 90 of cut-outs 74 and 78 may act as stops by contacting periphery 34 when cover 10 is properly seated on fin 30.

Although bridge 70 is among various optional features of cover 10, if present it may be useful in guiding fin 30 into hollow area 50. In particular, bridge 70 may contact and slide along trailing edge 94 of fin 30 as cover 10 is being positioned onto the fin 30. Thereafter, bridge 70 may at times function too as a stop, preventing unwanted downward movement of cover 10 relative to generally planar portion 82 of disc 14.

Figure 3:
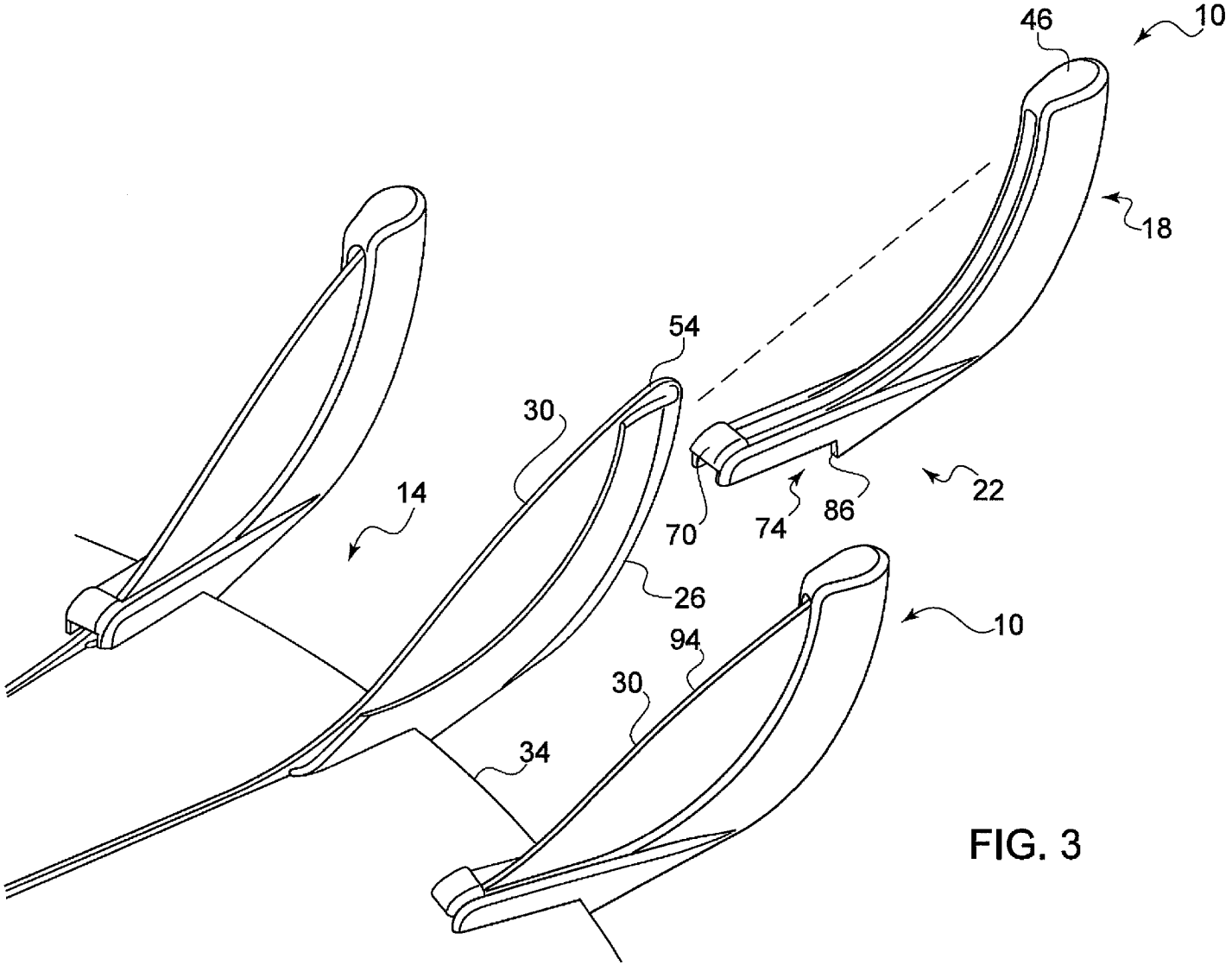
FIGS. 3-4 illustrate placement of covers such as that of FIG. 1 onto discs.
Figure 4:
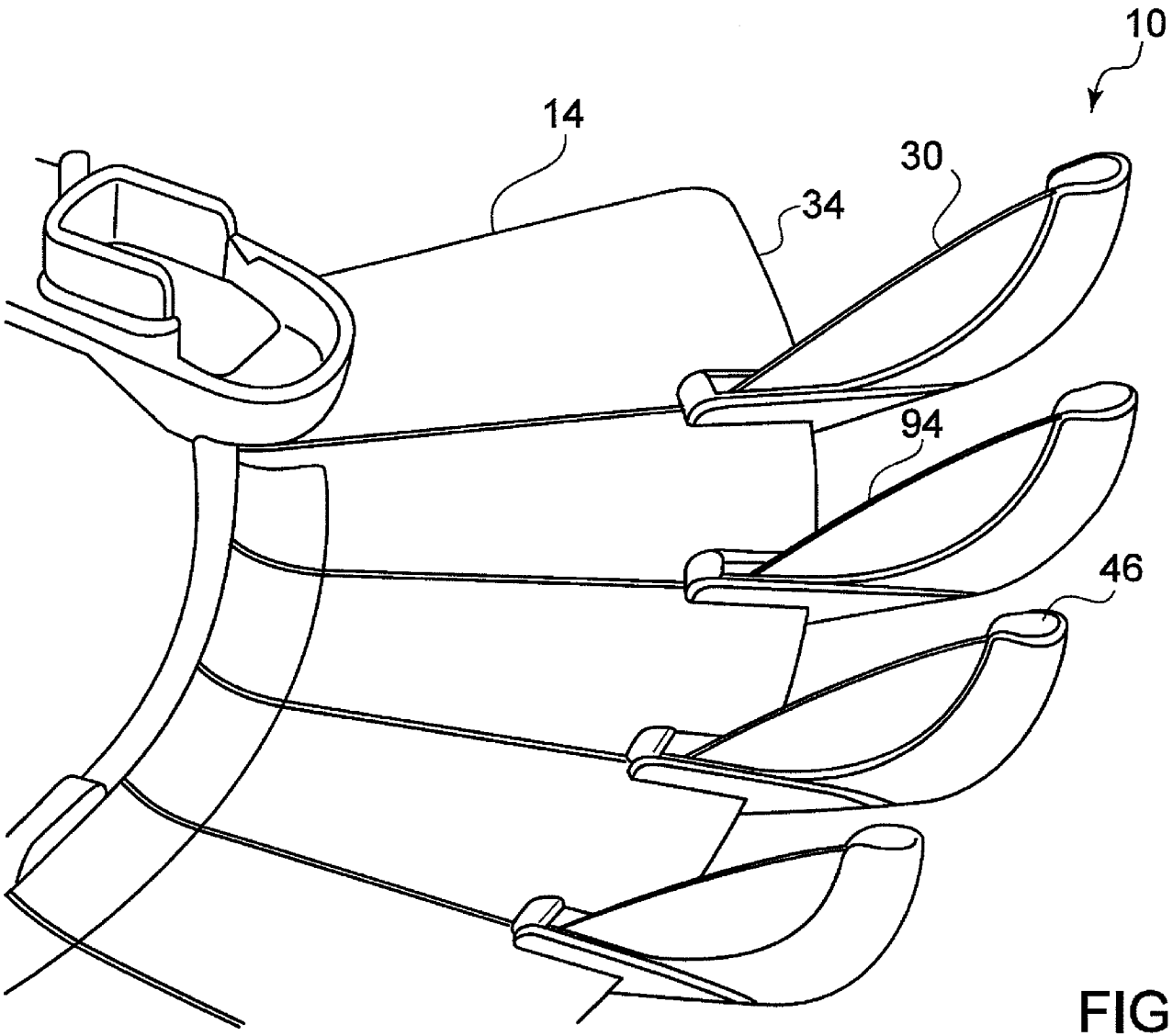
Figure 5:
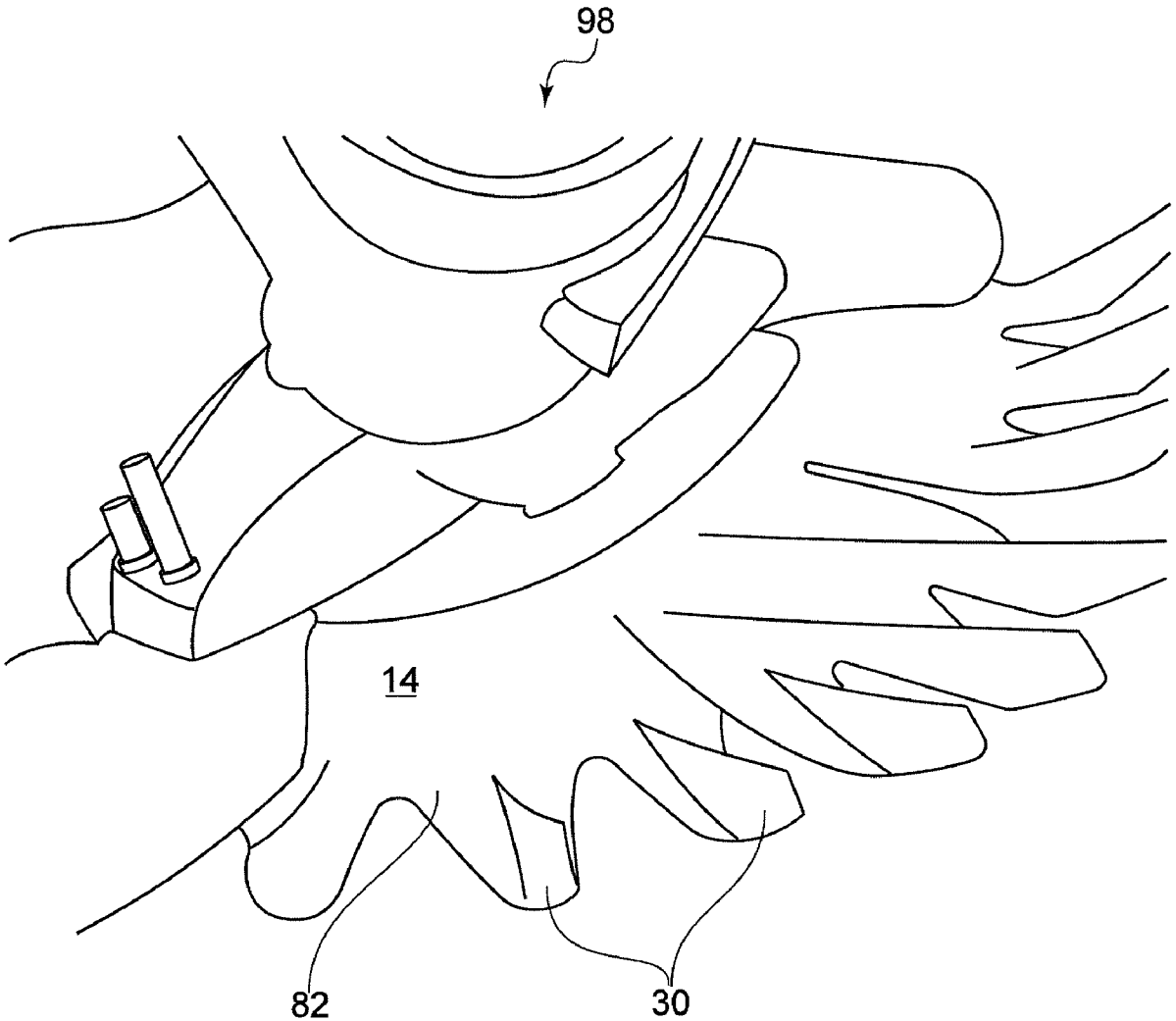
FIG. 5 shows portions of an automatic pool cleaner having a disc onto which covers such as that of FIG. 1 may be seated.

FIGS. 3-4 illustrate multiple covers 10 seated on fins 30 of disc 14. Not every fin 30 (or other protrusion) of disc 14 need be covered, however. Likewise, preferred covers 10 are removable under manual or other force from fins 10 and, therefore, need not necessarily be used with any disc 14. Nevertheless, deploying one or more covers 10 may be useful in certain situations, particularly in pools in which fins 30 tend to grip vertical pool walls and thereby slow climbing of the associated automatic pool cleaner (such as cleaner 98 of FIG. 5). Alternatively, covers 10 may be overmolded onto or permanently connected to fins 10 (via water-insoluble adhesive or otherwise) if appropriate or desired.

Enhancing rigidity of fins 30 utilizing covers 10 also may inhibit undesired lateral bending of the fins 30. Such lateral bending otherwise may occur when fins 30 contact obstacles or walls within pools. When fins 30 bend laterally upon contacting a vertical pool wall, the bending sometimes inhibits the associated cleaner from climbing the wall. Thus, preventing lateral bending of fins 30 may, at times, improve at least climbing performance of the cleaner.

The configuration and rigid nature of cover 10 also tend to integrate upward movement of fins 30 and disc 14. As a fin 30 commences upward flexing, end 66 of cover 10 begins depressing planar portion 82. This action in turn causes the portion of disc 14 between end 66 and periphery 34 to flex upward too. The overall effect of this activity is to decrease suction force applied to disc 14 near periphery 34, facilitating continued lifting of disc 14 when prompted to do so by the upward motion of fins 30.

The foregoing is provided for purposes of illustrating, explaining, and describing embodiments of the present invention. Modifications and adaptations to these embodiments will be apparent to those skilled in the art and may be made without departing from the scope or spirit of the invention. The disclosures of the Dawson and Rice patents and of the Moore application are hereby incorporated herein in their entireties by this reference.

What is claimed is:

1. An automatic swimming pool cleaner comprising:

a. a disc including (i) a generally planar portion and (ii) a peripheral portion (A) having a first hardness, (B) having a radially outer surface, and (C) extending upward from the generally planar portion; and b. a member covering at least part of the radially outer surface of the peripheral portion, the member having hardness greater than the first hardness.

2. An automatic swimming pool cleaner according to claim 1 in which the generally planar portion defines a periphery and the peripheral portion extends outward beyond the periphery.

3. An automatic swimming pool cleaner according to claim 2 in which the member is removable from the peripheral portion.

4. An automatic swimming pool cleaner according to claim 3 in which the radially outer surface has a first coefficient of friction and the member has a coefficient of friction less than the first coefficient of friction.

5. An automatic swimming pool cleaner according to claim 4 in which the peripheral portion comprises at least one fin.

6. An automatic swimming pool cleaner according to claim 5 in which the fin is frictionally received by the member.

7. An automatic swimming pool cleaner according to claim 1 in which the member comprises:

a. a generally vertically-oriented portion; and b. a generally horizontal portion.

8. An automatic swimming pool cleaner according to claim 7 in which the generally vertically-oriented portion comprises:

a. a wall having generally U-shaped cross-section; and b. a cap.

9. An automatic swimming pool cleaner according to claim 8 in which the wall defines a hollow area in which the peripheral portion is fitted.

10. An automatic swimming pool cleaner according to claim 9 in which the generally horizontal portion comprises:

a. first and second spaced walls, each having a cut-out therein; and b. a bridge connecting the first and second spaced walls.

11. An automatic swimming pool cleaner according to claim 10 in which the generally planar portion is received by the cut-outs in the first and second spaced walls.

12. An automatic swimming pool cleaner according to claim 1 in which the member is overmolded onto at least part of the peripheral portion.

13. An automatic swimming pool cleaner disc comprising:

a. a generally planar portion;

b. at least one flexible protrusion extending upward from the generally planar portion; and c. means, comprising a rigid member contacting the flexible protrusion, for enhancing rigidity of the flexible protrusion.

14. An automatic swimming pool cleaner disc according to claim 13 in which the rigid member is removable from the flexible protrusion.

15. An automatic swimming pool cleaner disc according to claim 14 in which the rigid member has a lower coefficient of friction than the flexible protrusion.

16. An automatic swimming pool cleaner disc according to claim 15 in which (a) the generally planar portion defines a periphery and (b) the flexible protrusion is a fin extending outward beyond the periphery.

17. A member for a protrusion of an automatic swimming pool cleaner disc having a generally planar portion, the member comprising:

a. means, comprising a generally vertically-oriented portion comprising a wall having generally U-shaped cross-section, for receiving the protrusion of the disc, the wall defining a hollow area into which the protrusion of the disc is configured to be fitted; and b. means, comprising a generally horizontal portion comprising first and second spaced walls, each having a cut-out therein, for receiving the generally planar portion of the disc.

18. A member according to claim 17 in which the generally vertically-oriented portion further comprises a cap.

19. A member according to claim 18 in which the generally horizontal portion further comprises a bridge connecting the first and second spaced walls.

20. A member according to claim 17 which is molded with the generally vertically-oriented portion and the generally horizontal portion being integral.

21. An automatic swimming pool cleaner comprising:

a. a disc including (i) a generally planar portion and (ii) a peripheral portion (A) having a first hardness and (B) extending upward from the generally planar portion; and b. a member contacting the peripheral portion and being removable therefrom, the member having hardness greater than the first hardness.

* * * * *